US009390845B2

(12) United States Patent
Rowe et al.

(10) Patent No.: US 9,390,845 B2
(45) **Date of Patent: *Jul. 12, 2016**

(54) CORE SHELL SUPERPARAMAGNETIC IRON OXIDE NANOPARTICLES WITH FUNCTIONAL METAL SILICATE CORE SHELL INTERFACE AND A MAGNETIC CORE CONTAINING THE NANOPARTICLES

(71) Applicant: Toyota Motor Engineering & Manufacturing North America, Inc., Erlanger, KY (US)

(72) Inventors: Michael Paul Rowe, Pinckney, MI (US); Ryan Daniel Desautels, Winnipeg (CA)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 99 days.

This patent is subject to a terminal disclaimer.

(21) Appl. No.: 14/296,917

(22) Filed: Jun. 5, 2014

(65) Prior Publication Data

US 2015/0357102 A1 Dec. 10, 2015

(51) Int. Cl.

| | |
|---|---|
| ***H01F 1/00*** | (2006.01) |
| ***H01F 1/37*** | (2006.01) |
| ***H01F 41/02*** | (2006.01) |
| ***H01F 3/08*** | (2006.01) |
| ***H01F 17/06*** | (2006.01) |

(52) U.S. Cl.

CPC ..... *H01F 1/0018* (2013.01); *H01F 1/0054* (2013.01); *H01F 3/08* (2013.01); *H01F 41/0246* (2013.01)

(58) Field of Classification Search

CPC ..... H01F 1/0054; H01F 1/37; H01F 1/36; H01F 3/08; H01F 27/263

See application file for complete search history.

(56) References Cited

U.S. PATENT DOCUMENTS

| | | | | |
|---|---|---|---|---|
| 4,601,765 | A | 7/1986 | Soileau et al. | |
| 5,512,317 | A | 4/1996 | Blagev | |
| 9,067,833 | B2 * | 6/2015 | Rowe | C04B 35/62807 |
| 9,093,205 | B2 * | 7/2015 | Rowe | H01F 1/0054 |
| 2010/0054981 | A1 | 3/2010 | Liu | |
| 2011/0207869 | A1 | 8/2011 | Katusic et al. | |
| 2012/0130023 | A1 | 5/2012 | Herzog et al. | |
| 2012/0208026 | A1 * | 8/2012 | Zhou | H01F 1/0054 428/404 |
| 2013/0342069 | A1 | 12/2013 | Rowe | |
| 2014/0027667 | A1 | 1/2014 | Rowe | |
| 2014/0035713 | A1 | 2/2014 | Rowe | |

OTHER PUBLICATIONS

Abstract for CN 102097194, Jun. 15, 2011.*

Bumb et al, "Synthesis and characterization of ultra-small superparamagnetic iron oxide nanoparticles thinlly coated with silica", Nanotechnology 19 (2008) 335601, pp. 1-6.*

U.S. Appl. No. 14/521,063, filed Oct. 22, 2014, Rowe, et al.

U.S. Appl. No. 13/900,860, filed May 23, 2013, Rowe.

Shouheng Sun, et al., "Size-Controlled Synthesis of Magnetite Nanoparticles" J. Am. Chem. Soc., vol. 124, No. 28, (p. 8204-8205), 2002.

A Bumb, et al., "Synthesis and Characterization of Ultra-Small Superparamagnetic Iron Oxide Nanoparticles Thinly Coated with Silica" Nanotechnology 19 (2008) 335601 (6 pg.).

Ming Zhang, et al., "Synthesis and Characterization of Monodisperse Ultra-Thin Salica-Coated Magnetic Nanoparticles" Nanotechnology 19 (2008) 085601 (5 pg.).

Shin Tajima, et al., "Properties of High-Density Magnetic Composite Fabricated From Iron Powder Coated with a New Type Phosphate Insulator" IEEE Transactions on Magnetics, vol. 41, No. 10, (p. 3280-3282), Oct. 2005.

H S Park, et al., "Synthesis of Silica-Coated Ferromagnetic Fine Powder by Heterocoagulation" J. Phys. Condens. Matter 20 (2008) 204105 (6 pg.).

Chih Hao Yu, et al., "Immobilization of BSA on Silica-Coated Magnetic Iron Oxide Nanoparticle" J. Phys. Chem. C, vol. 113, No. 2, (p. 537-543), 2009.

U.S. Appl. No. 14/270,619, filed May 6, 2014, Rowe, et al.

U.S. Appl. No. 14/270,752, filed May 6, 2014, Rowe, et al.

U.S. Appl. No. 14/252,036, filed Apr. 14, 2014, Rowe, et al.

U.S. Appl. No. 13/942,116, filed Jul. 15, 2013, Rowe, et al.

U.S. Appl. No. 13/921,878, filed Jun. 19, 2013, Rowe.

* cited by examiner

*Primary Examiner* — Carol M Koslow

(74) *Attorney, Agent, or Firm* — Oblon, McClelland, Maier & Neustadt, L.L.P.

(57) ABSTRACT

Core shell nanoparticles of an iron oxide core, a silicon dioxide shell and an iron silicate interface between the core and the shell are provided. The magnetic properties of the nanoparticles are tunable by control of the iron silicate interface thickness. A magnetic core of high magnetic moment obtained by compression sintering the thermally annealed superparamagnetic core shell nanoparticles is also provided. The magnetic core has little core loss due to hysteresis or eddy current flow.

16 Claims, 2 Drawing Sheets

CORE SHELL SUPERPARAMAGNETIC IRON OXIDE NANOPARTICLES WITH FUNCTIONAL METAL SILICATE CORE SHELL INTERFACE AND A MAGNETIC CORE CONTAINING THE NANOPARTICLES

BACKGROUND OF THE INVENTION

1. Field of the Invention

The present invention relates to superparamagnetic core shell nanoparticles having an iron oxide core, a silica shell and a metal silicate interface layer between the iron oxide core and silica shell and a magnetic core produced with these nanoparticles. The core of the present invention is suitable for utility in power generation parts such as stators, rotors, armatures and actuators or any device whose function is dependent upon an efficient magnetic core, i.e., a magnetic core having a high magnetic moment, minimal magnetic hysteresis and no or little eddy current formation.

2. Discussion of the Background

Many electronic devices rely on magnetic cores as a method of transferring a magnetic field. Due to inefficiency caused by core loss, a portion of this power is lost, typically as waste heat. A core's magnetic properties have the ability to greatly concentrate and enhance magnetic fields. Thus, improving and implementing core materials with low loss as well as high magnetic permeability would enormously enhance the efficiency of the device. With increased interest in environmentally-conscious devices, the implementation of improved magnetic core material across millions and millions of devices that require them (all computers, TVs, cell phones, vehicle power electronics, etc.) could produce significant benefits for global energy conservation.

Magnetic materials generally fall into two classes which are designated as magnetically hard substances which may be permanently magnetized or soft magnetic materials which may be reversed in magnetism at low applied fields. It is important in soft magnetic materials that energy loss, normally referenced as "core loss" is kept to a minimum whereas in hard magnetic materials it is preferred to resist changes in magnetization. High core losses are therefore characteristic of permanent magnetic materials and are undesirable in soft magnetic materials.

The use of powdered magnetic materials allows the manufacture of magnetic parts having a wide variety of shapes and sizes. However, materials made from consolidated powdered magnetic materials have been limited to utility in applications involving direct currents. Direct current applications, unlike alternating current applications, do not require that the magnetic particles be insulated from one another in order to reduce eddy currents.

Conventionally, magnetic device parts are constructed from powders by compaction of the powders to a defined shape and then sintering the compact at temperatures of 600° C. or higher. Sintering the part following compaction, is necessary to achieve satisfactory mechanical properties in the part by providing particle to particle bonding and hence strength. However, sintering may cause volume changes and results in a manufacturing process with poor dimensional control.

In other processes designed to prepare parts having minimum eddy current losses, the magnetic particles are coated with thermoplastic materials before pressing. The plastic is provided to act as a barrier between the particles to reduce induced eddy current losses. However, in addition to the relatively high cost of such coatings, the plastic has poor mechanical strength and as a result, parts made using plastic-coated particles have relatively low mechanical strength. Additionally, many of these plastic-coated powders require a high level of binder when pressed. This results in decreased density of the pressed core part and, consequently, a decrease in magnetic permeability and lower induction. Additionally, and significantly, such plastic coatings typically degrade at temperatures of 150-200° C. Accordingly, magnetic parts made in such manner are generally limited to utility in low stress applications for which dimensional control is not critical.

Soft magnetic core components are frequently used in electrical/magnetic conversion devices such as motors, generators and transformers and alternators, particularly those found in automobile engines. The most important characteristics of soft magnetic core components are their maximum induction, magnetic permeability, and core loss characteristics. When a magnetic material is exposed to a rapidly varying magnetic field, a resultant energy loss in the core material occurs. These core losses are commonly divided into two principle contributing phenomena: hysteresis and eddy current losses. Hysteresis loss results from the expenditure of energy to overcome the retained magnetic forces within the core component. Eddy current loss, the other source of core loss, refers to circular currents setup within the magnetic core due to the applied magnetic field, as explained by Faraday's Law. Eddy current losses are brought about by the production of induced currents in the core component due to the changing flux caused by alternating current (AC) conditions. These circular currents create a magnetic field anti-parallel to the applied field, decreasing the overall field within the core. In order to reduce eddy current formation, materials with low electrical conductivities are used.

Magnetic core inefficiency is measured in terms of core loss. To improve core loss, the magnetic core must demonstrate a reduced measure of magnetic hysteresis as well as lowered eddy current formation.

Another important magnetic property of materials for soft magnetic components is the magnetic saturation ($M_s$) of the material. Magnetic saturation is empirically measured and is representative of the total magnetic moment of a material sample. A low $M_s$ can limit the application utility of a material and therefore, a high $M_s$ is an important property to be an effective and useful magnetic material.

The magnetic saturation is influenced by a number of factors, which includes material composition, crystallinity and the stress-strain exerted on the material during production.

Applicants have described a magnetic core of significantly reduced magnetic hysteresis and low eddy current formation obtained by sintering superparamagnetic core shell nanoparticles having an iron oxide core and silica shell into a monolithic core structure in U.S. application Ser. No. 13/529,316, filed Jun. 21, 2012, issued as U.S. Pat. No. 9,067,833 on Jun. 30, 3015, the disclosure of which is incorporated herein by reference in its entirety. A core of high magnetic saturation based on core shell nanoparticles having an iron oxide core and silica shell was described in U.S. application Ser. No. 13/900,860, filed May 23, 2013, issued as U.S. Pat. No. 9,093,205 on Jul. 28, 2015, the disclosure of which is incorporated herein by reference in its entirety.

However, there remains a need for magnetic powders having controllable or tunable magnetic properties which allow for production of tailored soft magnetic parts, having green strength, high temperature tolerance, and good mechanical properties, which provide parts having minimal or essentially no core loss and high magnetic moment.

Conventionally, ferromagnetic powders have been employed for the production of soft magnetic core devices.

Such powders are generally in a size range measured in microns and are obtained by a mechanical milling diminution of a bulk material. Superparamagnetic nanoparticle materials having particle size of less than 100 nm have found utility for magnetic record imaging, as probes for medical imaging and have been applied for targeted delivery of therapeutic agents. However, the utilization of superparamagnetic powders of nanoparticles for production of core magnetic parts has until now, been limited.

Herzog et al. (U.S. 2012/0130023) describes a heat activated initiator composition for cross linking and curing polymers. In addition to a peroxide or compound having a labile carbon-carbon bond, the composition contains core shell magnetic particles. The core may be iron oxide or other magnetic material such as Fe, Co, Ni or an alloy such as FePt. The particle size of the core is 5-100 nm. The shell is a silica shell. However, multiple shells are possible and a metal silicate layer near the core is described. These core shell nanoparticles are produced by flame pyrolysis and nowhere is "tuning" the magnetic properties of the nanoparticles disclosed. Moreover, nowhere is formation of a magnetic core described.

Katusic et al. (U.S. 2011/0207869) describes core shell nanoparticles produced by flame pyrolysis. The core is an iron oxide and the shell is a silicon oxide. A bonding layer containing an iron silicate is present between the core and the shell. As these core shell nanoparticles are produced by flame pyrolysis "tuning" the magnetic properties of the nanoparticles is not disclosed. Moreover, nowhere is formation of a magnetic core described.

Liu (U.S. 2010/0054981) describes a bulk nanocomposite permanent magnet having a combination of hard phases and soft phases intermixed. CoFe is included as an example of a soft magnetic alloy. Synthesis of FePt nanoparticles is described and coating of the FePt nanoparticle with $Fe_3O_4$ is also described. However, no core shell structures of a soft phase particle coated with an insulative silica shell is disclosed or suggested.

Blagev (U.S. Pat. No. 5,512,317) describes coated iron oxide particles having a coating of a cobalt doped iron oxide and a silicate. The particles are not nano-sized and are of the order of 0.1 to 0.4 μm. However, this reference does describe a type of metal silicate interface layer on the iron oxide particles. "Tuning" the magnetic properties of the particles by control of the thickness of metal silica interface is not disclosed.

Soileau et al. (U.S. Pat. No. 4,601,765) describes a coated iron powder which is compacted to a magnetic core. The powder is less than 0.05" in particle size and therefore not a nanoparticle according to the present invention. This reference does describe a combination of silicate coating and silicon coating on the powder but does not disclose or suggest "tuning" the magnetic properties of the particles and formed core by control of the thickness of the metal silicate interface.

Sun et al (J. Am. Chem. Soc., 2002, 124, 8204-8205) describes a method to produce monodisperse magnetite nanoparticles which can be employed as seeds to grow larger nanoparticles of up to 20 nm in size. Silica coating and metal silicate interface is not disclosed by this reference.

Bumb et al. (Nanotechnology, 19, 2008, 335601) describes synthesis of superparamagnetic iron oxide nanoparticles of 10-40 nm encapsulated in a silica coating layer of approximately 2 nm. Utility in power transformers is referenced, but no description of preparation of core structures is provided. "Tuning" the magnetic properties of the particles by control of the thickness of metal silica interface is not disclosed.

Zhang et al. (Nanotechnology, 19, 2008, 085601) describes synthesis of silica coated iron oxide particles. The average size of the iron oxide particle to be coated is 8 to 10 nm and the silica core is about 2 nm. "Tuning" the magnetic properties of the particles by control of the thickness of metal silica interface is not disclosed.

Tajima et al. (IEEE Transactions on Magnetics, Vol. 41, No. 10, October, 2005) describes a method to produce a powder magnetic core described as warm compaction using die wall lubrication (WC-DWL). According to the method an iron powder coated with a phosphate insulator was compacted under a pressure of 1176 MPa at a temperature of 423K to produce a core type structure.

Park et al. (J. Phys. Condens. Matter. 20, 2008, 204105) describes the synthesis of core-shell nanoparticles (described as temperature-sensitive ferrite (TSF) covered with silica). The ferrite core (mean diameter of 10 nm) was prepared by coprecipitation in an alkaline solution. Then, silica coating was carried out by the controlled hydrolysis and condensation of tetraethyl orthosilicate (TEOS). The core-shell particles were formed by a surface precipitation procedure using TSF nanoparticles as a core material. The thickness of the silica layer on TSF cores was observed by means of transmission electron microscopy (TEM). However, "tuning" the magnetic properties of the particles by control of the thickness of metal silica interface is not disclosed.

Yu et al. (J. Phys. Chem. C 2009, 113, 537-543) describes the preparation of magnetic iron oxide nanoparticles encapsulated in a silica shell. Utility of the particles as magnetic binding agents for proteins is studied.

None of the above references recognizes the significance of a metal silicate interface which is formed between the core and silica shell. None of these references disclose or suggest that core shell nanoparticles having an iron oxide core and silica shell with an iron silicate interface can be tuned with respect to magnetic properties by control of the thickness of the iron silicate layer. Likewise, none of the above references disclose or suggest a monolithic magnetic core constructed by heated compression of nanoparticular iron oxide encapsulated in a silica shell having an iron silicate interface layer of controlled thickness, wherein the particles are directly compacted without addition of lubricant or other material to facilitate particle adherence.

An object of the present invention is to provide a magnetic powder to produce soft magnetic parts, having in addition to increased green strength, high temperature tolerance, good mechanical properties, minimal or essentially no core loss, high magnetic saturation and a property of being tunable in terms of magnetic properties.

A second object of the invention is to provide a magnetic core having a high total magnetic moment and little or no core loss wherein the magnetic properties can be altered or controlled according to the tunable properties of the core shell nanoparticles.

A third object is to provide a method to produce a magnetic core or shaped core part having a high total magnetic moment and little or no core loss.

SUMMARY OF THE INVENTION

These and other objects have been achieved according to the present invention, the first embodiment of which includes a superparamagnetic core shell nanoparticle, comprising: a superparamagnetic core comprising an iron oxide; a shell of a silicon dioxide coating the core; and an iron silicate interface layer between the core and the silicon dioxide shell; wherein a diameter of the iron cobalt alloy core is 200 nm or less, the core shell particle is obtained by a process comprising: wet chemical precipitation of the core; coating of the core with a wet chemical silicate synthesis to form the silicon dioxide shell, and the thickness of the metal silicate interface is controlled by the time of the wet chemical synthesis.

In an aspect of the first embodiment, the iron silicate interface may be from 0.5 to 10 nm in thickness and the thickness may be controlled by length of time of the wet synthesis to prepare the silicon dioxide shell.

In a second embodiment, the present invention provides a magnetic core, comprising: a plurality of the superparamagnetic core shell nanoparticles according to the first embodiment; wherein the magnetic core is a monolithic structure of superparamagnetic core grains of an iron oxide directly bonded by the silicon dioxide shells, which form a silica matrix, and a layer comprising iron silicate interfaces the core to the matrix.

In a further embodiment, the present invention provides a method to prepare a monolithic magnetic core, the magnetic core comprising the superparamagnetic core shell particles of any of the previous embodiments.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION OF THE INVENTION

Figure 1:
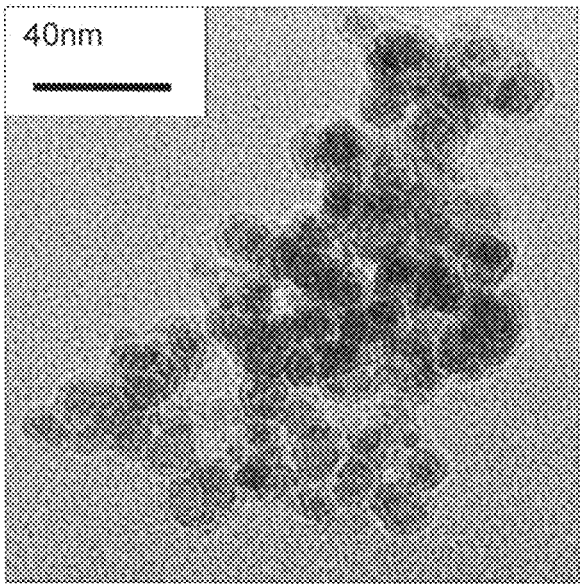
FIG. 1 shows a TEM image of the nanoparticles prepared in the Example.

Throughout this description all ranges described include all values and subranges therein, unless otherwise specified.

Additionally, the indefinite article "a" or "an" carries the meaning of "one or more" throughout the description, unless otherwise specified.

Where a numerical limit or range is stated, the endpoints are included. Also, all values and subranges within a numerical limit or range are specifically included as if explicitly written out.

The inventors have discovered that the formation of individual iron oxide nanoparticles coated with silica shells of various thicknesses may be achieved via a scalable wet chemical process. Surprisingly, the inventors have discovered that formation of interfacial iron silicates may alter significantly the nanomagnetism in these ultra-high surface area iron oxide nanoparticle systems. Evidence that an interfacial layer of iron silicates had formed was observed in x-ray photoelectron spectra collected over the 2p transition of Fe; and as the thickness of the silica shell was increased (by altering the duration of the silica reaction) a thicker interfacial metal silicate layer was formed, increasing the nanoparticles' overall magnetic anisotropy, as evidenced by increased blocking temperatures and altered coercivities. Thus the inventors have surprisingly discovered that by producing superparamagnetic iron oxide nanoparticles that are encapsulated in silica shells with varying degree of wet synthesis treatment time, core shell iron oxide nanoparticles having differing nanomagnetic properties may be obtained. Compacting and sintering these nanoparticles with tuned magnetic properties into a monolithic nanomaterial provides a core having zero (or very low) hysteresis and very low eddy current formation.

Thus, the first embodiment of the present invention includes a superparamagnetic core shell nanoparticle, comprising: a superparamagnetic core of an iron oxide; a shell of a silicon dioxide coating the core; and an iron silicate interface layer between the core and the silicon dioxide shell; wherein a diameter of the iron oxide core is 200 nm or less, the core shell particle is obtained by a process comprising: wet chemical precipitation of the core; coating of the core with a wet chemical silicate synthesis to form the silicon dioxide shell, and the thickness of the iron silicate interface is controlled by the time of the wet chemical synthesis. In certain embodiments the diameter of the iron oxide nanoparticle core is 100 nm or less, and in further embodiments the diameter of the iron oxide nanoparticle core is from 2 to 75 nm, preferably from 2 nm to 50 nm, and most preferably from 2 to 20 nm.

According to the invention, the iron oxide nanoparticle grains are of or approaching the size of the single particle magnetic domain of the iron oxide and thus are superparamagnetic. While not being constrained to theory, the inventors believe control of grain size to approximately that of the particle magnetic domain is a factor which contributes to the reduced hysteresis of a magnetic core according to the present invention. Moreover, the presence of insulating silica shells about the core grains is a factor which contributes to the low eddy current formation of a magnetic core according to the present invention.

It is conventionally known that the range of particle size for which single domain particles exhibit superparamagnetism has an upper boundary characteristic of the particle chemical composition.

The inventors have discovered that during synthesis of the silicon dioxide shell an iron silicate thin layer interface is coincidentally formed. The iron silicate of the interface layer comprises an iron orthosilicate of a formula: $Si_9Fe_{2.5}O_4$. Evidence that an interfacial layer of iron silicates had formed was observed in x-ray photoelectron spectra collected over the 2p transition of Fe; and as the thickness of the silica shell was increased (by altering the duration of the silica reaction) a thicker interfacial iron silicate layer was formed, increasing the nanoparticles' overall magnetic anisotropy, as evidenced by increased blocking temperatures and altered coercivities. The inventors have recognized that an understanding of the effect of this interfacial metal silicate layer to control magnetic properties is a key element to effective utility of these materials in applications as low-loss transformer cores.

In a study of FeCo alloy core shell nanoparticles described in copending application Ser. No. 14/252,036, filed Apr. 14, 2014, the inventors have discovered that interfacial metal silicates formed during the silicon dioxide shell coating synthesis, alter the overall magnetic anisotropy of the nanoparticles as a higher anisotropy phase that is a combination of Fe- and Co-based silicates that acts to increase the 'magnetically active volume' of the nanoparticles compared to a bare FeCo nanoparticle. Applicants believe the same effects as disclosed in the referenced copending application are obtained with the iron oxide nanoparticles according to the present invention.

Nanoparticles of iron oxide/$SiO_2$ may be synthesized by the aqueous reaction of a ferric salt such as ferric chloride (Iron (III) chloride) with a ferrous salt such as ferrous dichloride (iron (II) chloride in a solution of ammonium hydroxide. The resulting nanoparticles, represented by the formula: $Fe_3O_4$, may be washed with dilute nitric acid and water and then treated with tetraethyl orthosilicate, in water ethanol mixture using triethylamine as the base-catalyst, to form silica shells. After precipitation at pH between 2 and 7, the particles may be washed with an aqueous ethanol rinse or with ethanol.

As indicated, the length of the treatment of the iron oxide nanoparticles determines the width of the silicon dioxide coating and correspondingly, the width of the iron silicate layer. The longer the treatment time, the greater the amount of the coating and the greater the width of the iron silicate layer.

The synthesis may be conducted for such time as necessary to prepare an iron silicate layer of 0.25 to 20 nm, preferably 0.8 to 15 nm and most preferably 1.0 to 8 nm.

In another embodiment, the present invention includes a magnetic core, comprising: the iron oxide core shell nanoparticles having a particle size of less than 200 nm, for example 2 to 160 nm, preferably less than 100 nm and most preferably from 2 to 50 nm; wherein the magnetic core is a monolithic structure of superparamagnetic core grains of an iron oxide directly bonded by the silicon dioxide shells, which form a silica matrix, and a layer comprising iron silicate which interfaces the core to the matrix.

The core according to the present invention is monolithic, having the space between the iron oxide nanoparticle grains occupied by the silicon dioxide and the iron silicate interface. Preferably at least 97% of the space between the grains, preferably 98% and most preferably 99% of the space is occupied by the silicon dioxide and the iron silicate. In a most preferred embodiment the space between the iron oxide nanoparticle grains is occupied substantially only by the silicon dioxide and the iron silicate. According to the present invention neither any binder nor any resin is contained in the matrix of the monolithic core.

The monolithic core according to the present invention is obtained by a process comprising sintering a powder of the superparamagnetic core shell particles having a particle size of less than 200 nm under pressure under flow of an inert gas to obtain a monolithic structure; wherein the core comprises a superparamagnetic iron oxide nanoparticle in a matrix of a silicon dioxide and an interface layer between the core and the shell comprises iron silicate. In a preferred embodiment the core of the core/shell particle consists of the superparamagnetic iron oxide nanoparticle, and the shell consists of silicon dioxide with the iron silicate interface there between. In a further variant of the process the core shell nanoparticles may be treated at a temperature of from 125° C. to 600° C. for from 3 to 7200 seconds before the sintering under heat and pressure. Because a magnetic material is only superparamagnetic when the grain size is near or below the magnetic domain size, the nanoparticle core must be maintained as small as possible, or the sample will become ferromagnetic, and express magnetic hysteresis. Therefore, the most mild and gentle sintering conditions that still yield a monolithic sample that is robust enough to be machined into a toroid are desired, because more aggressive sintering conditions will promote unwanted grain growth and potentially, loss of superparamagnetic performance.

The magnetic core as described herein may be employed as a component in an electrical/magnetic conversion device, as known to one of ordinary skill in the art. In particular the magnetic core according to the present invention may be a component of a vehicle part such as a motor, a generator, a transformer, an inductor and an alternator, where high magnetic moment is advantageous.

Having generally described this invention, a further understanding can be obtained by reference to certain specific examples which are provided herein for purposes of illustration only and are not intended to be limiting unless otherwise specified. Skilled artisans will recognize the utility of the devices of the present invention as a battery as well as the general utility of the electrolyte system described herein.

EXAMPLE

Synthesis of Fe-Oxide/$SiO_2$ Core/Shell Nanoparticles

Fe-oxide/silica core/shell nanoparticles and nanocomposite were synthesized as follows:

$FeCl_3$ $6H_2O$ (4.444 g) and $FeCl_2$ $4H_2O$ (1.654 g) were dissolved in $H_2O$ (190 mL). Ammonium hydroxide (10 mL) was added to the reaction. The product was washed with 2M nitric acid, and then water. The nanoparticles were re-dispersed in water, and the pH was raised to 7 using additional ammonium hydroxide. Triethylamine (5.5 mL) was introduced to the suspension and allowed to mix fully. Tetraethyl orthosilicate (TEOS, 1.4 mL) in ethanol (123 mL) was added to this nanoparticle suspension, and stirred for 15 mins. The silica-coated iron oxide nanoparticles were precipitated from solution by lowering the pH to between 7 and 8 using 2M nitric acid, and then washed with ethanol. A TEM image of the nanoparticles is shown in FIG. 1.

Figure 2:
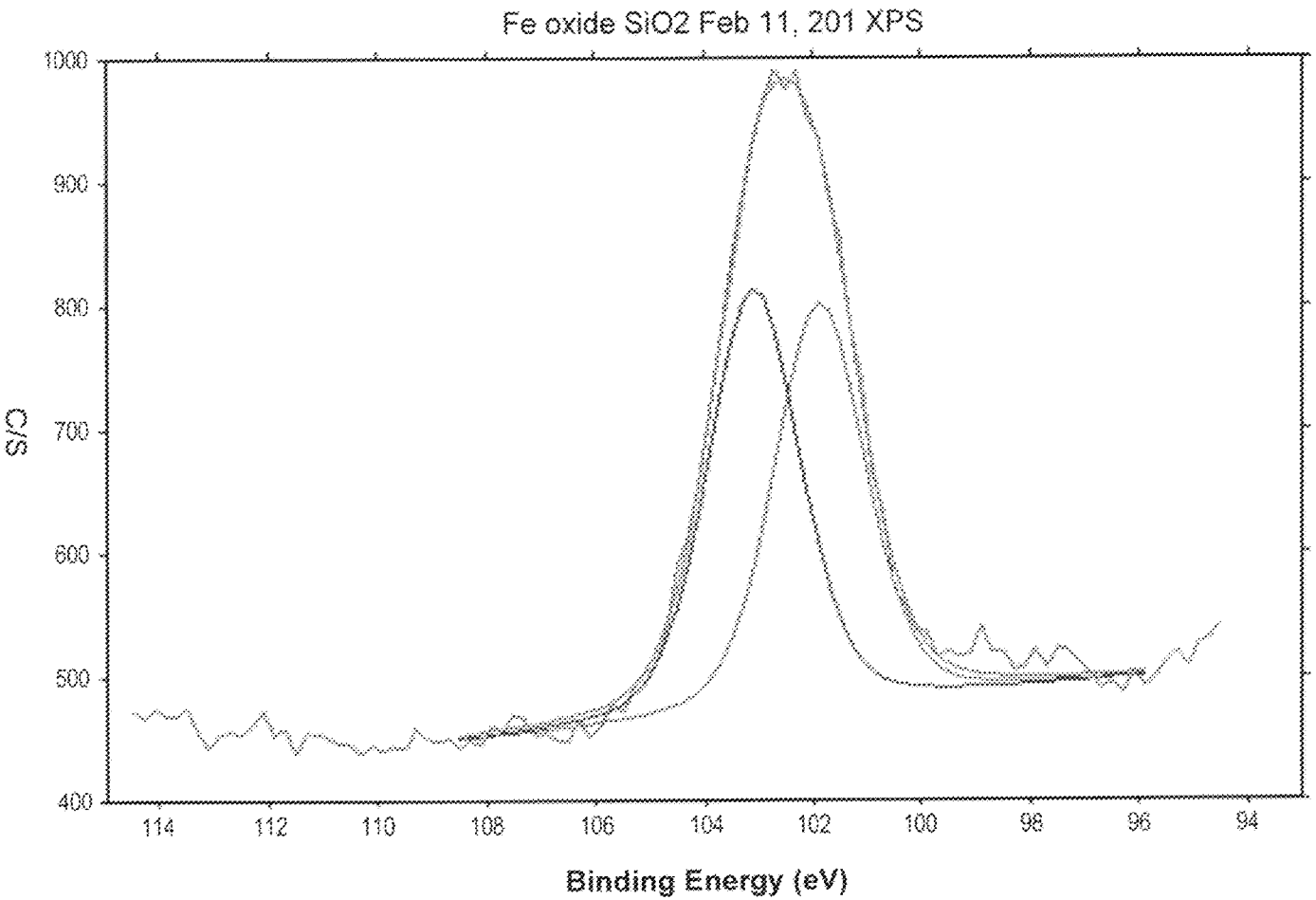
FIG. 2 shows a X-ray photoelectron spectroscopy performed over the Si2p binding energies for the nanoparticles prepared in the Example.

X-ray photoecectron spectroscopy (XPS) analysis of the silica-coated iron oxide nanoparticle clearly showed the presence of an iron silicate at the interface of the iron oxide surface and silicon dioxide coating. (see FIG. 2) This iron silicate interface layer formed from the application of the silica shell to the nanoparticle surface during synthesis. It is known that iron silicate can be antiferromagnetic, this property may effect the overall moment of the sample as a function of interface layer thickness.

The above description is presented to enable a person skilled in the art to make and use the invention, and is provided in the context of a particular application and its requirements. Various modifications to the preferred embodiments will be readily apparent to those skilled in the art, and the generic principles defined herein may be applied to other embodiments and applications without departing from the spirit and scope of the invention. Thus, this invention is not intended to be limited to the embodiments shown, but is to be accorded the widest scope consistent with the principles and features disclosed herein. In this regard, certain embodiments within the invention may not show every benefit of the invention, considered broadly.

The invention claimed is:

1. A superparamagnetic core shell nanoparticle, comprising:

a superparamagnetic core of an iron oxide;

a shell of a silicon dioxide coating the core; and an iron silicate interface layer between the core and the silicon dioxide shell;

wherein a diameter of the iron oxide core is 200 nm or less, the core shell particle is obtained by a process comprising:

wet chemical precipitation of the core;

coating of the core with a wet chemical silicate synthesis to form the silicon dioxide shell, and the thickness of the iron silicate interface is controlled by the time of the wet chemical synthesis.

2. The superparamagnetic core shell nanoparticle according to claim 1, wherein the iron silicate of the interface layer comprises an iron orthosilicate of a formula: $Si_2Fe_{2.5}O_4$.

3. The superparamagnetic core shell nanoparticle according to claim 1, wherein the thickness of the iron silicate interface layer is from 0.25 nm to 20 nm.

4. The superparamagnetic core shell nanoparticle according to claim 1, wherein the superparamagnetic iron oxide core comprises a compound of formula: $Fe_3O_4$.

5. The superparamagnetic core shell nanoparticle according to claim 1, wherein the diameter of the iron oxide core is from 2 to 75 nm.

6. A magnetic core, comprising:

a plurality of the superparamagnetic core shell nanoparticles according to claim 1;

wherein the magnetic core is a monolithic structure of superparamagnetic core grains of an iron oxide directly bonded by the silicon dioxide shells, which form a silica matrix, and a layer comprising iron silicate interfaces the core to the matrix.

7. The magnetic core according to claim 6, wherein a space between individual superparamagnetic iron oxide nanoparticles is occupied substantially only by the silicon dioxide and the iron silicate.

8. The magnetic core according to claim 7, wherein the superparamagnetic core comprises $Fe_3O_4$.

9. The magnetic core according to claim 7, wherein at least 97% by volume of the space between the superparamagnetic core grains of iron oxide is occupied by silicon dioxide and the iron silicate.

10. The magnetic core according to claim 7, wherein an average grain size of the superparamagnetic core grains of iron oxide is from 2 to 160 nm.

11. A method to prepare a monolithic magnetic core, the magnetic core comprising superparamagnetic core shell particles having a particle size of less than 200 nm;

the method comprising sintering the superparamagnetic core shell nanoparticles of claim 1, under heat and pressure and under flow of an inert gas to obtain a monolithic structure;

wherein the core comprises a superparamagnetic iron oxide nanoparticle in a matrix of a silicon dioxide and an interface layer between the core and the shell comprises iron silicate.

12. The method according to claim 11, further comprising heating the core shell nanoparticles at a temperature of from 125° C. to 600° C. for from 3 to 7200 seconds before the sintering under heat and pressure.

13. An electrical/magnetic conversion device, which comprises a magnetic core according to claim 6.

14. An electrical/magnetic conversion device, which comprises a magnetic core according to claim 7.

15. A vehicle part comprising the electrical/magnetic conversion device according to claim 13, wherein the part is selected from the group consisting of a motor, a generator, a transformer, an inductor and an alternator.

16. A vehicle part comprising the electrical/magnetic conversion device according to claim 14, wherein the part is selected from the group consisting of a motor, a generator, a transformer, an inductor and an alternator.

* * * * *